US006336855B1

(12) United States Patent
Ohmori et al.

(10) Patent No.: US 6,336,855 B1
(45) Date of Patent: Jan. 8, 2002

(54) GRINDSTONE FOR ELID GRINDING AND APPARATUS FOR ELID SURFACE GRINDING

(75) Inventors: Hitoshi Ohmori, Wako; Nobuhide Itoh, Hitachi; Susumu Shimizu, Tokyo; Shinji Ishii, Tokyo; Manabu Yamada, Tokyo; Kiyoshi Imai, Tokyo; Kineo Kojima, Tokyo, all of (JP)

(73) Assignee: Riken, Saitama (JP)

( * ) Notice: Subject to any disclaimer, the term of this patent is extended or adjusted under 35 U.S.C. 154(b) by 0 days.

(21) Appl. No.: 09/571,852

(22) Filed: May 16, 2000

(30) Foreign Application Priority Data

May 17, 1999 (JP) ..... 11-135137

(51) Int. Cl.[7] ..... B24B 55/02

(52) U.S. Cl. ..... 451/450; 451/449; 451/550; 451/548

(58) Field of Search ..... 451/259, 262, 451/269, 268, 446, 548, 550, 449, 41

(56) References Cited

U.S. PATENT DOCUMENTS 4,918,872 A * 4/1990 Sato et al. ..... 451/41
5,060,424 A * 10/1991 Sato et al. ..... 451/267
5,076,024 A * 12/1991 Akagawa et al. ..... 451/266
5,533,923 A * 7/1996 Shamouilian et al. ..... 451/41
5,605,488 A * 2/1997 Ohashi et al. ..... 451/288
5,816,900 A * 10/1998 Nagahara et al. ..... 451/285
5,853,317 A * 12/1998 Yamamoto ..... 451/288
6,033,293 A * 3/2000 Crevasse et al. ..... 451/285
6,116,991 A * 9/2000 Liu et al. ..... 451/285
6,217,423 B1 * 4/2001 Ohmori et al. ..... 451/267

* cited by examiner

*Primary Examiner*—Derris H. Banks
*Assistant Examiner*—Lee Wilson
(74) *Attorney, Agent, or Firm*—Griffin & Szipl, P.C.

(57) ABSTRACT

There is provided a conductive grinding wheel 10 rotating centering on a vertical shaft center and including a horizontal working surface 10*a*, and the grinding wheel comprises a conductive base member 11 formed of an integrally molded flat plate, and a plurality of fan-shaped segments 12 detachably attached to the base member to entirely constitute the annular working surface. Each segment comprises a base metal 12*a* directly attached to the base member and a grinding wheel part 12*b* formed on the surface of the base metal. Moreover, the grinding wheel part comprises a recessed groove 14 for partitioning the working surface into a plurality of working areas 13, and an electrolytic fluid supply hole 15 for directly supplying the electrolytic fluid to the respective working areas, so that the electrolytic fluid is supplied to the respective electrolytic fluid supply holes through the base member.

8 Claims, 4 Drawing Sheets

Fig.4 (II)
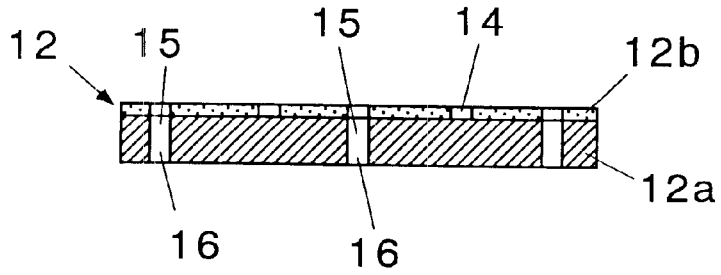
Fig.4 (III)
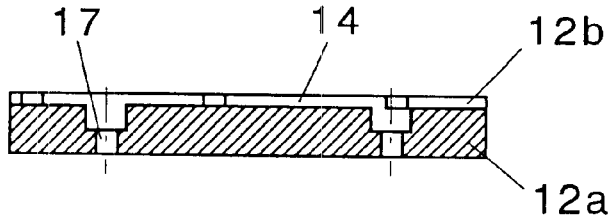
Fig.5
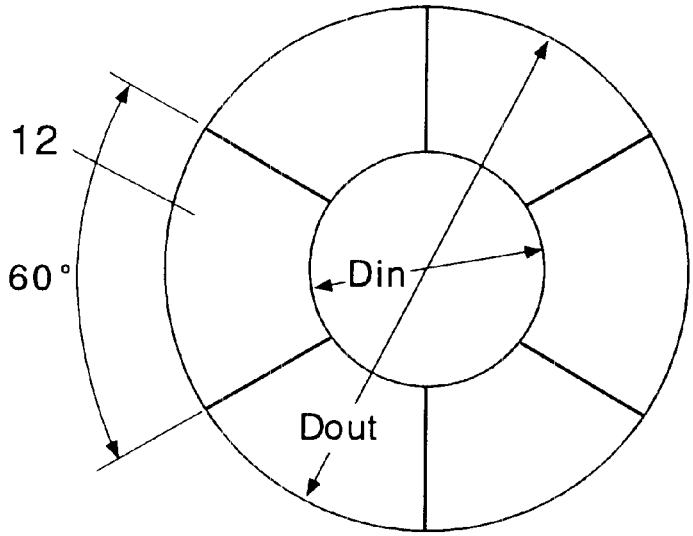

GRINDSTONE FOR ELID GRINDING AND APPARATUS FOR ELID SURFACE GRINDING

BACKGROUND OF THE INVENTION

1. Field of the Invention

The present invention relates to an ELID grinding wheel for performing electrolytic dressing while grinding a workpiece, and to an ELID surface grinding apparatus using the grinding wheel.

2. Description of Related Art

In order to grind a high-precision magnetic disk substrate, mainly a plane lapping machine has heretofore been used. This plane lapping machine is the lapping machine of a simultaneous double-sided lapping system. In the machine, gears are formed in the periphery of a fixture to which a workpiece is attached, the fixture meshes with the middle and peripheral gears to rotate itself and the machine, a pressure by an upper cylinder is applied, a loose abrasive material is interposed between a tool called a lapping plate and the workpiece, and lapping is performed by the relative movement of the lapping plate and the workpiece.

Although the above-described conventional lapping apparatus (e.g., the plane lapping machine) has a characteristic that a high machining accuracy can be obtained by relatively simple equipment, but contrarily has the following problems.

(1) Since the losse abrasive is used in the lapping, the lapping is very low (1/10 or less of the grinding removal rate), and the lapping requires much time. Therefore, large-sized equipment is usually used, and a plurality of magnetic disk substrates are simultaneously lapped, but the lapping time per disk is long.

(2) The lapping plate as a standard is preparaed beforehand with a high accuracy, and the workpiece is grinded in conformity with the standard. Therefore, when the accuracy of the lapping plate itself is deteriorated by wear, the re-sharpening is necessary again. In this case, "mutual lapping" which is a process for grinding the upper and lower lapping plates with each other is usually performed. Although irregularities are flattened by this means, but squareness cannot be secured with respect to a rotating shaft, and the parallelism of the worked workpiece is deteriorated. Specifically, in a constant-pressure lapping system, truing (mutual lapping) can be performed on the machine. However, even when the flatness of a grinding wheel (lapping plate) is enhanced, the parallelism between a workpiece holding jig and the grinding wheel cannot be adjusted, and the parallelism of both workpiece surfaces (thickness precision) cannot be enhanced by this adjustment.

Furthermore, in recent years, the breakage of a hard disk, and particularly the breakage of a motor have frequently occurred. One of the causes for this lies in the unbalance of the thickness of the magnetic disk substrate. Specifically, there is a problem that the eccentric force generated by the unbalance of the magnetic disk substrate shortens the motor bearing life, and the motor breaks in a short time. Therefore, in order to enhance the reliability of the hard disk, it has strongly been desired that the parallelism (thickness precision) of the magnetic disk substrate be enhanced more than before. However, if this tries to be achieved by the above-described conventional lapping machine, the lapping time is further lengthened, which is impractical and raises a problem.

In order to solve various above-described problems, the present inventors, et al. have devised "Mirror Working Apparatus and Method of Magnetic Disk Substrate" (Japanese Patent Application No. 136198/1998, not laid open) and filed an application. In this invention, as schematically shown in FIG. 1, the apparatus comprises: a metal bond grinding wheel 2 which rotates centering on a vertical shaft center Z1 and includes a horizontal working surface 2*a*; workpiece holding rotation means 4 which includes a horizontal support surface 4*a* disposed opposite to the working surface and rotates centering on a vertical shaft center Z2; voltage applying means 6 which uses the metal bond grinding wheel as an anode, and an electrode 6*a* disposed opposite to the working surface of the metal bond grinding wheel in a non-contact manner as a cathode, and applies a pulse voltage between both electrodes; and electrolytic fluid supply means 8 for supplying a electrolytic fluid to the working surface of the metal bond grinding wheel, and the workpiece holding rotation means 4 brings a disc-shaped magnetic disk substrate 1 or a disc-shaped truing grinding wheel in close contact with the support surface to hold and rotate the substrate or the grinding wheel, and is constituted to be horizontally and vertically movable. The method by this apparatus comprises: (A) plane-working the working surface 2*a* of the metal bond grinding wheel on the machine; subsequently electrolytic dressing the metal bond grinding wheel; and simultaneously performing (B) grind-working of the support surface 4*a* of the workpiece holding rotation means and (C) grind-working of the magnetic disk substrate 1 attached to the workpiece holding rotation means alternately on the machine. Additionally, in FIG. 1, numerals 3, 5 denote drive apparatus.

According to this apparatus and method, as compared with the conventional lapping apparatus, the removal rate of the magnetic disk substrate can largely be enhanced, and both surface parallelism (thickness precision) and surface roughness of workpiece can be enhanced more than before.

In the conventional art, the grinding wheel 2 shown in FIG. 1 is integrally molded and the surface 2*a* is entirely formed into a flat surface without any recess. However, when the grinding wheel 2 is enlarged in size with the enlargement of the workpiece 1 (magnetic disk substrate), in order to manufacture the large-sized grinding wheel with a high accuracy by press molding and sintering, there are many limitations in respect of equipment and there is a problem that manufacture cost is excessively increased.

Moreover, since the surface of the grinding wheel is a flat surface without any recess, an electrolytic fluid is not easily supplied to a gap with the workpiece, and there is a problem that chips and grinding wheel pieces generated by grinding are not easily removed from the grinding wheel surface. Therefore, scratches are generated on the workpiece by the chips or grinding wheel pieces generated during grinding, the supply of the electrolytic fluid partially becomes insufficient and the electrolytic dressing becomes insufficient, and other problems occur.

Furthermore, when the supply amount of the electrolytic fluid is excessively increased to prevent the scratches, the workpiece floats up from the grinding wheel by the pressure of the electrolytic fluid so that the grinding cannot be performed, that is, a so-called hydroplaning phenomenon easily occurs.

SUMMARY OF THE INVENTION

The present invention has been developed to solve the above-described problems. Specifically, an object of the present invention is to provide an ELID conductive grinding wheel in which size is easily enlarged, chips and grinding wheel pieces can smoothly be removed, insufficient grind fluid does not easily occur, and hydroplaning phenomenon does not easily occur and to provide an ELID surface grinding apparatus which uses this grinding wheel.

According to the present invention, there is provided an ELID grinding wheel which is a conductive grinding wheel rotating centering on a vertical shaft center and including a horizontal working surface, the grinding wheel comprises a conductive base member of an integrally molded flat plate, and a plurality of fan-shaped segments detachably attached to the base member to entirely constitute the working surface in an annular shape, each segment comprises a base metal directly attached to the base member and a grinding wheel part formed on the surface of the base metal, the grinding wheel part comprises a recessed groove for partitioning the working surface into a plurality of working areas and an electrolytic fluid supply hole for directly supplying an electrolytic fluid to the respective working areas, so that the electrolytic fluid is supplied to each electrolytic supply hole through the base member.

According to the constitution of the present invention, since the conductive grinding wheel comprises the conductive base member of the integrally molded flat plate and a plurality of fan-shaped segments detachably attached to the base member to entirely constitute the annular working surface, the fan-shaped segment is reduced in size, and a large-sized grinding wheel can easily be manufactured using conventional molding equipment and sintering equipment.

Moreover, since the grinding wheel parts of the respective segments include a plurality of working areas partitioned by the recessed grooves, and the electrolytic fluid is directly supplied from the electrolytic supply holes disposed in the respective working areas, the electrolytic fluid flows in a radial one direction from the electrolytic fluid supply hole to the recessed groove surrounding the hole, and the chips and grinding wheel pieces can smoothly be removed with this flow. Furthermore, since it is easy to supply an optimum amount of electrolytic fluid to the respective working areas, the insufficient grind fluid does not easily occur, and the hydroplaning phenomenon by the excessive fluid does not easily occur.

According to a preferred embodiment of the present invention, the respective working areas have substantially the same area, the respective electrolytic fluid supply holes have substantially the same sectional area and the same number of holes are disposed in the respective working areas. According to this constitution, only by supplying substantially the same amount of electrolytic fluid to the respective working areas, the insufficient or excessive part of the grinding fluid can be prevented from being generated over the entire working surface.

Moreover, the base metal is provided with an electrolytic fluid supply port connected to each electrolytic fluid supply hole. Since the electrolytic fluid supply port is disposed, the electrolytic fluid can easily be supplied to each electrolytic fluid supply hole through the base member.

Furthermore, the recessed groove includes a boundary groove extending in the radial direction of the grinding wheel along a boundary line with the adjacent segment, a middle groove disposed between the boundary grooves and extending in the radial direction of the grinding wheel, and an intersecting groove extending to intersect the boundary groove and/or the middle groove. According to this constitution, the chips and grinding wheel pieces having reached the intersecting groove can smoothly be discharged to the outside of the grinding wheel through the boundary groove and/or the middle groove by the action of a centrifugal force.

Moreover, according to the present invention, there is provided an ELID surface grinding apparatus comprising an electrolytic fluid supply apparatus for distributing/supplying a conductive electrolytic fluid to a plurality of electrolytic fluid supply ports of the above-described ELID grinding wheel.

According to the constitution of the present invention, the conductive electrolytic fluid can be distributed/supplied to the plurality of electrolytic fluid supply ports of each ELID grinding wheel from the electrolytic fluid supply apparatus.

According to the preferred embodiment of the present invention, the electrolytic fluid supply apparatus includes an electrolytic fluid chamber disposed in the upper part of the grinding wheel, and a plurality of pipelines for independently connecting the chamber to the respective electrolytic fluid supply ports. According to this constitution, the electrolytic fluid pooled in the electrolytic fluid chamber can be distributed/supplied to the respective electrolytic fluid supply ports by its own weight, and the constitution is suitable especially for the upper grinding wheel.

Moreover, the electrolytic fluid supply apparatus may be constituted of a rotary connector disposed on the rotation centerline of the grinding wheel, and a plurality of pipelines for independently connecting the rotary connector to the respective electrolytic fluid supply ports. According to this constitution, even in the lower grinding wheel, the electrolytic fluid can smoothly be supplied to the respective electrolytic fluid supply ports from the rotary connector.

Other objects and advantageous characteristics of the present invention will be apparent from the following description with reference to the accompanying drawings.

BRIEF DESCRIPTION OF THE DRAWINGS

FIG. 4(II) is a sectional view in II–II' line of FIG. 3, and FIG. 4(III) is a sectional view in III–III' line of FIG. 3.

FIG. 5 is a constitution diagram of a segment 12 in a case where a circular arc center angle is 60 degrees.

DETAILED DESCRIPTION OF THE PREFERRED EMBODIMENTS

Figure 1:
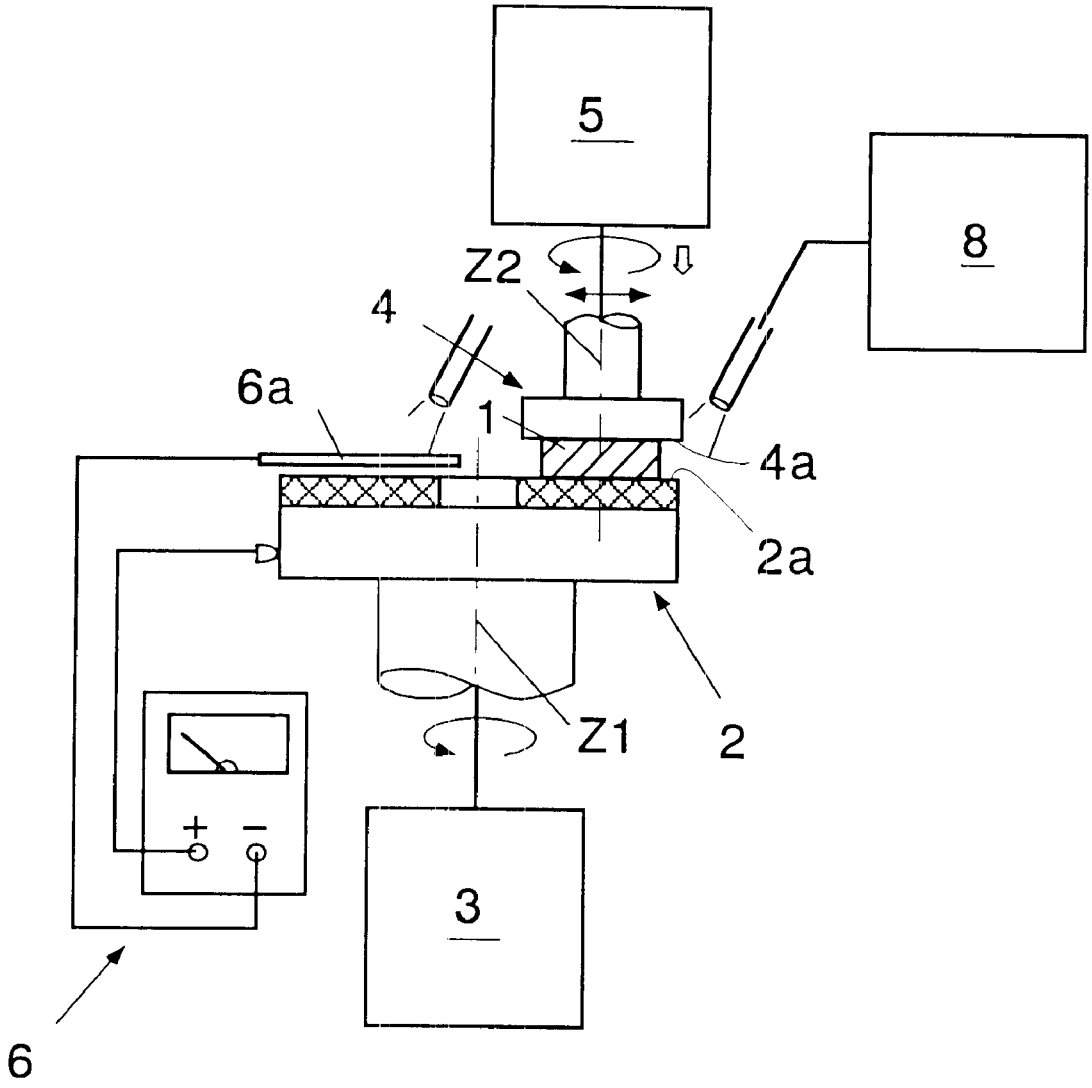
Fig.1 (Prior Art)
FIG. 1 is a schematic illistration of a mirror finishing apparatus according to the prior application which has not been laid open.

Preferred embodiments of the present invention will be described hereinafter with reference to the drawings. Additionally in the respective drawings, common members are denoted with the same reference numerals and redundant description is omitted.

The present inventors et al. have developed "Electrolytic Dressing Method and Apparatus for Conductive Grinding wheel" which is referred to as an electrolytic inprocess dressing grinding method (ELID grinding method) (Japanese Patent Publication No. 075823/1994). In the method and apparatus, a satisfactory mirror surface and smooth flat surface can be obtained with a high efficiency and high speed by applying a voltage to a conductive grinding wheel, and electrolytic dressing the conductive grinding wheel.

In the ELID grinding method, since the clogging of the grinding wheel is not caused by the electrolytic dressing, with fine abrasive grains a remarkably superior working surface like the mirror surface can be obtained by a grinding work, and the mirror surface can be worked at a speed several ten times that of lapping with a loose abrasive material. The present invention has been achieved by further developing the ELID grinding method with a higher precision.

Figure 2:
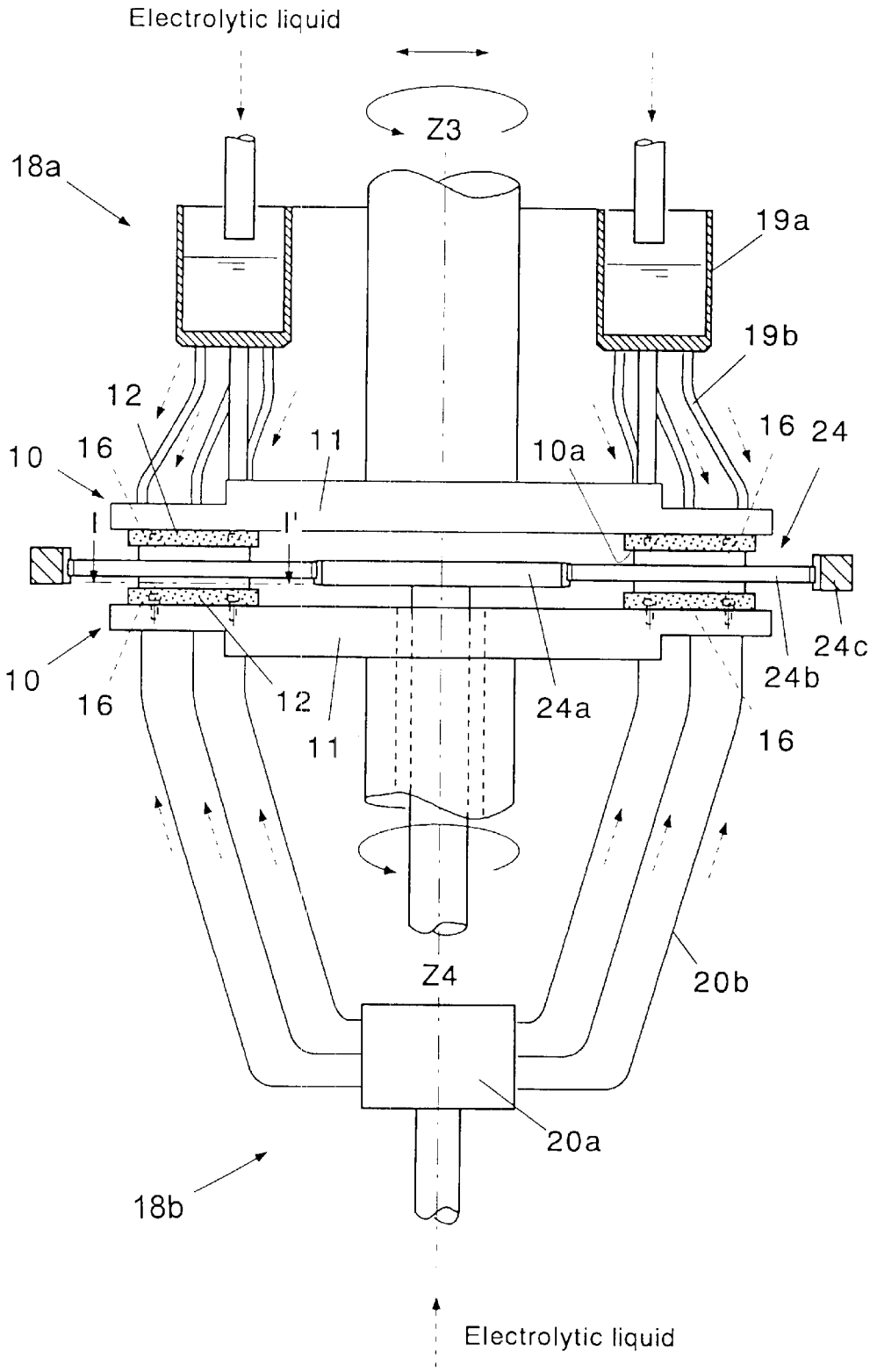
FIG. 2 is an entire constitution diagram of an ELID surface grinding apparatus which uses an ELID grinding wheel of the present invention.

FIG. 2 is an entire constitution diagram of an ELID surface grinding apparatus using an ELID grinding wheel of the present invention. This ELID surface grinding apparatus is constituted of voltage applying means (not shown), an electrolytic fluid supply apparatus 18, upper and lower ELID grinding wheels 10, and workpiece holding rotation means 24.

The upper and lower ELID grinding wheels 10 are conductive grinding wheels, include working surfaces 10*a* disposed opposite to each other, and are rotated/driven centering on vertical shaft centers Z3, Z4 by independent drive apparatus (not shown). The shaft centers Z3, Z4 are constituted parallel to each other with a high precision. Moreover, either one of the upper and lower grinding wheels can move horizontally and vertically in addition to the rotation/driving. According to this constitution, by relatively horizontally moving the upper and lower grinding wheels 10, and allowing the grinding wheels to closely abut on each other on the machine, the respective working surfaces 10*a* can horizontally be plane-worked.

In this example, the workpiece holding rotation means 24 includes a sun gear 24*a* which are independently rotated/driven centering on the center shaft Z4 of the lower grinding wheel 10, a planet gear 24*b* which meshes with the sun gear 24*a*, and a ring gear 24*c* which meshes with the outer periphery of the planet gear 24*b*. The planet gear 24*a* is provided with a through hole in which the workpiece 1 (e.g., magnetic disk substrate) is loosely engaged in a position deviating from the rotation center. Moreover, this planet gear 24*a* is constituted to be always positioned in the middle position between the upper and lower grinding wheels 10.

According to this constitution, by rotating the planet gear 24*b* in an appropriate angle range, the workpiece 1 is held between the upper and lower grinding wheels 10, rotated centering on the vertical axis and can horizontally be rocked. Specifically, in this example, the planet gear 24*b* functions as a carrier for holding/rocking the workpiece 1. Additionally, the carrier 24*b* is thicker than an electrode (not shown).

The voltage applying means (not shown) can set the upper and lower grinding wheels 10 to be plus (+). Moreover, the carrier 24*b* can be set simultaneously with the electrode or switched to be minus (−) via an electric supply wire connected to the carrier 24*b* of the workpiece holding rotation means 24.

The electrolytic fluid supply apparatus 18 positioned above the ELID surface grinding apparatus of FIG. 2 is constituted of an electrolytic fluid chamber 19*a* disposed above the upper grinding wheel 10, and a plurality of pipelines 19*b* for independently connecting the chamber 19*a* to an electrolytic fluid supply port 16 disposed in the grinding wheel 10. According to this constitution, the electrolytic fluid stored in the electrolytic fluid chamber 19*a* can be distributed/supplied to the respective electrolytic fluid supply ports 16 (described later) by its own weight, and the constitution is suitable particularly for the upper grinding wheel.

Moreover, the electrolytic fluid supply apparatus 18 positioned below the ELID surface grinding apparatus of FIG. 2 is constituted of a rotary connector 20*a* disposed on the rotation center line of the lower grinding wheel 10, and a plurality of pipelines 20*b* for independently connecting the rotary connector 20*a* to the electrolytic fluid supply port 16 disposed in the grinding wheel 10. According to this constitution, even in the lower grinding wheel, the electrolytic fluid can smoothly be supplied to the respective electrolytic fluid supply ports 16 from the rotary connector 20*a*.

Therefore, according to the constitution, the conductive electrolytic fluid can be distributed/supplied to the electrolytic fluid supply port 16 of each ELID grinding wheel 10 by the electrolytic fluid supply apparatus 18. Additionally, the electrolytic fluid supply apparatus 18 using the rotary connector 20*a* is not limited to the lower grinding wheel, and may be used on the upper grinding wheel.

Figure 3:
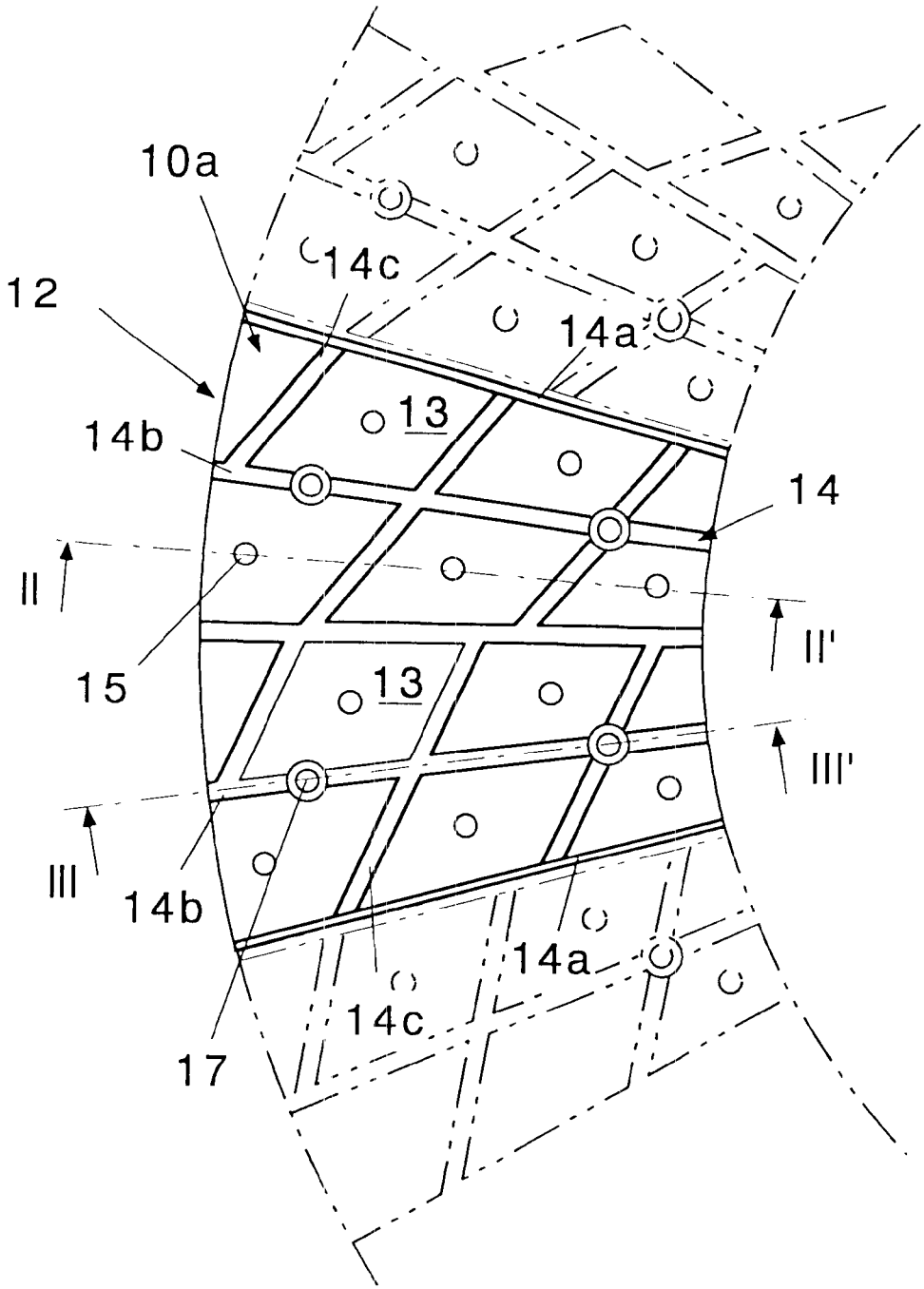
FIG. 3 is a partial view in I–I' line of FIG. 2.

FIG. 3 is a partial view in I–I' line of FIG. 2. Moreover, FIG. 4(II) is a sectional view in II–II' line of FIG. 3, and FIG. 4(III) is a sectional view in III–III' line.

As shown in FIG. 2, the ELID grinding wheel 10 of the present invention is constituted of a conductive base member 11 formed of an integrally molded flat plate, and a plurality of fan-shaped segments 12 detachably attached to the base member 11 with a bolt, and the like.

Moreover, as shown in FIG. 3, the plurality of fan-shaped segments 12 are adjacent to one another to entirely constitute the annular working surface 10*a*. Furthermore, as shown in FIGS. 4(II) (III), each segment 12 is constituted of a base metal 12*a* directly attached to the base member 11 of FIG. 2 and a grinding wheel part 12*b* formed on the surface of the base metal.

The surface of the segment 12, that is, the grinding wheel part 12*b* includes a recessed groove 14 (grooving) for partitioning the working surface into a plurality of working areas 13, and an electrolytic fluid supply port 15 for directly supplying the electrolytic fluid to the respective working areas 13.

The recessed groove 14 is constituted of a boundary groove 14*a* extending in the radial direction of the grinding wheel along a boundary line with the adjacent segment, a middle groove 14*b* disposed between the boundary grooves 14*a* and extending in the radial direction of the grinding wheel, and an intersecting groove 14*c* extending to intersect the boundary groove 14*a* and/or the middle groove 14*b*. The size of each recessed groove (grooving) is set to an appropriate size for passing the chips, for example, a depth of around 3 mm and width of around 4 mm. Moreover, the boundary groove 14*a* is constituted to be narrow (e.g., 2 mm) so that the same grooving is disposed in a gap with the adjacent segment. According to this constitution, the chips and grinding wheel pieces having reached the intersecting groove 14C can smoothly be discharged to the outside of the grinding wheel through the boundary groove and/or the middle groove by the action of a centrifugal force. Additionally, in this example, the intersecting groove 14*c* is obliquely disposed to form the flow of the chips by the action of the centrifugal force, but this constitution is not indispensable, and the groove may be disposed in an arbitrary direction, for example, radial direction.

Moreover, in this example, the respective working areas 13 have substantially the same area. Furthermore, the respective electrolytic fluid supply holes 15 have substantially the same sectional area and the same number of holes (one hole in this example) are disposed in the respective working areas 13. According to this constitution, only by supplying substantially the same amount of electrolytic fluid to the respective working areas, the insufficient or excessive part of the electrolytic fluid can be prevented from being generated over the entire working surface 10*a*.

As shown in FIG. 4(II), the base metal 12*a* is provided with the electrolytic fluid supply ports 16 connected to the respective electrolytic fluid supply holes 15. Additionally, in this example, the electrolytic fluid supply hole 15 and electrolytic fluid supply port 16 are constituted of the common through hole, but the single electrolytic fluid supply port 16 may be disposed, and an inner manifold may be disposed for connection to the plurality of electrolytic fluid supply holes 15 inside the base member 11. Moreover, a channel connected to the electrolytic fluid supply port 16 is disposed in the base member 11 of FIG. 2, and the electrolytic fluid is supplied to the respective electrolytic fluid supply holes 15 through the base member 11.

Moreover, as shown in FIG. 4(III), an attachment hole 17 is disposed in a part of the segment in which the head of a bolt is set to be lower than the grooving bottom, and the respective segments 12 are detachably attached to the base member 11 by this attachment hole 17. Furthermore, the relative position can accurately be determined by a positioning tool (not shown), for example, a knock pin.

Assuming that the center angle of the circular arc of the segment 12 shown in FIG. 5 is 60 degrees and a segment area is 258 $cm^2$, the segment 12 is constituted of six pieces considering from the grinding wheel total area. When the grinding wheel total area is changed, the division number results in Table 1. In examples 1 to 3, the division number varies in a range of 2 to 8. In this case, the center angle is in a range of 180 degrees to 45 degrees.

TABLE 1

| Example | Segment | Division No. | Angle | Inner Dia. | Outer Dia. | Grinding wheel Total Area |
|---|---|---|---|---|---|---|
| Example 1 | 258 $cm^2$ | 2 | 180° | 162 mm | 275 mm | 387.6 $cm^2$ |
| Example 2 | same | 6 | 60° | 324 | 550 | 1550.6 |
| Example 3 | same | 8 | 45° | 648 | 1100 | 1975.2 |

According to the above-described constitution of the present invention in the ϕ3.5 in. magnetic disk, since the conductive grinding wheel 10 is constituted of the conductive base member 11 formed of the integrally molded flat plate, and a plurality of fan-shaped segments 12 detachably attached to the base member to entirely constitute the annular working surface, the fan-shaped segment 12 is reduced in size, and the conventional molding equipment and sintering equipment can be used to easily manufacture the large-sized grinding wheel.

Moreover, since each segment grinding wheel part 12*b* is constituted of the plurality of working areas 13 partitioned by the recessed groove 14 (grooving), and the electrolytic fluid is directly supplied from the electrolytic fluid supply holes 15 disposed in the respective working areas, the electrolytic fluid flows in one radial direction from the electrolytic fluid supply hole 15 to the recessed groove 14 surrounding this hole, and the chips and grinding wheel pieces can smoothly be removed with the flow. Moreover, since the optimum amount of electrolytic fluid can easily be supplied to the respective working areas, the grinding fluid insufficient part is not easily generated, and the hydroplaning phenomenon by the excessive part is not easily generated.

[Example]

In order to confirm the effect of the above-described recessed groove 14 (grooving), three types of grinding wheels provided with no grooving, ten grooves and 20 grooves were tested. As a result, for the surface roughness measured value (Ra measured value: unit of angstrom), when there was no grooving, the value was 1298 at maximum, 14 at minimum, and 127 on average. On the other hand, for ten grooves the value indicated 258 at maximum, 14 at minimum, and 31 on average, for 20 grooves the value indicated 28 at maximum, 12 at minimum, and 18 on average, and a superior surface roughness was obtained.

Particularly, for Ra maximum value, the grinding wheel provided with no grooving indicated Ra 1298, but the grinding wheel provided with ten grooves indicated Ra 258, the grinding wheel provided with 20 grooves indicated Ra 28, and the value was remarkably improved. Therefore, it is seen that according to the present invention, with the flow of the electrolytic fluid the chips and grinding wheel pieces are smoothly removed, the scratches are prevented, the insufficiency or excess of the grinding fluid is prevented, and a satisfactory ELID grinding is performed.

As described above, for the ELID grinding wheel of the present invention and the ELID surface grinding apparatus using this grinding wheel, the size enlargement is facilitated, the chips and grinding wheel pieces can smoothly be removed, the grinding fluid insufficient part is not easily generated, the hydroplaning phenomenon does not easily occur, and other superior effects are provided.

Additionally, the present invention is not limited to the above-described embodiment, and can variously be modified within the scope of the present invention. For example, the working of both surfaces of the workpiece has been described above in the embodiment, but the present invention is not limited to this, and can similarly be applied to single surface grinding.

What is claimed is:

1. An ELID grinding wheel that is a conductive grinding wheel rotatingly centered on a vertical shaft center and including a horizontal working surface, the grinding wheel comprising:

a conductive base member formed of an integrally molded flat plate; and a plurality of fan-shaped segments detachably attached to the base member to entirely constitute said working surface in an annular shape, each segment comprising a base metal directly attached to the base member and a grinding wheel part formed on the surface of the base metal, the grinding wheel part having a recessed groove for partitioning said working surface into a plurality of working areas and a respective electrolytic fluid supply hole for each working area for directly supplying an electrolytic fluid to the corresponding working area, so that electrolytic fluid is supplied to each working area through a respective electrolytic fluid supply hole.

2. An ELID grinding wheel according to claim 1, wherein each working area of said plurality of working areas has substantially the same area as any other working area of said plurality of working areas, and each electrolytic fluid supply hole has substantially the same sectional area as any other electrolytic fluid supply hole.

3. An ELID grinding wheel according to claim 2 wherein each base metal is provided with at least one electrolytic fluid supply port connected to at least one corresponding electrolytic fluid supply hole.

4. An ELID grinding wheel according to claim 1, wherein said recessed groove includes a boundary groove extending in the radial direction of the grinding wheel defining a boundary line between adjacent segments, a middle groove disposed between two boundary grooves and extending in the radial direction of the grinding wheel, and an intersecting groove extending to intersect at least one of the boundary groove and the middle groove.

5. An ELID grinding wheel according to claim 1 wherein said plurality of fan-shaped segments numbers from two to eight segments.

6. An ELID surface grinding apparatus comprising:

an electrolytic fluid supply apparatus for distributing and supplying a conductive electrolytic fluid to a plurality of electrolytic fluid supply ports of the ELID grinding wheel of claim 3.

7. An ELID surface grinding apparatus according to claim 6 wherein said electrolytic fluid supply apparatus comprises an electrolytic fluid chamber disposed above said grinding wheel and a plurality of pipelines for independently connecting said chamber to each electrolytic fluid supply port.

8. An ELID surface grinding apparatus according to claim 6 wherein said electrolytic fluid supply apparatus comprises a rotary connector disposed on a rotation centerline of said grinding wheel, and a plurality of pipelines for independently connecting said rotary connector to the respective electrolytic fluid supply ports.

* * * * *